US005893220A

United States Patent [19]

Miller

[11] Patent Number: 5,893,220

[45] Date of Patent: Apr. 13, 1999

[54] ELASTOMERIC THERMAL COVER FOR SKI BOOTS

[76] Inventor: Joy Miller, P.O. Box 81149, Fairbanks, Ak. 99708

[21] Appl. No.: 08/864,445

[22] Filed: May 28, 1997

Related U.S. Application Data

[63] Continuation-in-part of application No. 08/689,013, Jul. 30, 1996, abandoned.

[51] Int. Cl.[6] ..... A43B 3/16; A43B 3/18

[52] U.S. Cl. ..... 36/7.1 R; 36/7.2

[58] Field of Search ..... 36/7.1 R, 7.2, 36/7.5, 2 R, 115

[56] References Cited

U.S. PATENT DOCUMENTS

| | | | |
|---|---|---|---|
| 1,222,737 | 4/1917 | Dahlin | 36/7.2 X |
| 2,292,770 | 8/1942 | Platkin | 36/7.2 |
| 2,949,912 | 8/1960 | Shapiro | 36/7.1 R |
| 2,984,917 | 5/1961 | Saunders | 36/7.2 X |
| 3,027,660 | 4/1962 | Werner | 36/7.1 R |
| 3,875,687 | 4/1975 | Henderson | 36/7.1 R |
| 4,259,791 | 4/1981 | Bazan | 36/7.2 |
| 4,445,287 | 5/1984 | Garcia | 36/106 |

FOREIGN PATENT DOCUMENTS

| | | | |
|---|---|---|---|
| 0631632 | 8/1982 | Switzerland | 36/7.1 R |

*Primary Examiner*—B. Dayoan
*Attorney, Agent, or Firm*—Tom Hamill, Jr.

[57] ABSTRACT

A ski boot cover is provided which is impervious to snow, moisture and wind and provides thermal insulation from the cold while permitting the wearer to manipulate adjustment devices located on the external surface of the shaft of the boot. The cover includes a body which is generally triangular. The body has a perimeter having a first, second and third side. The first side and the second side are connected by a first strip. The first side, second side and first strip define an opening for receiving the front portion of the ski boot with the first strip residing on the bottom of the boot. The first side and second side are also connected about the rear of the ski boot by a second strip. The second strip includes hook and loop fasteners. The first, second and third sides are fashioned in such a manner to, when attached to the ski boot, cover the front portion of the boot from the toe portion up through the instep, the lower right and left sides of the boot and the rear of the boot with a thermally insulative material. The shaft of the boot as well as the front and rear portions of the boot which would be attached to the ski bindings remain exposed. This permits manipulation of the latches, ski boot adjustment devices as well as attachment to the ski bindings. Covers for both the left and right ski boot are provided.

20 Claims, 6 Drawing Sheets

ELASTOMERIC THERMAL COVER FOR SKI BOOTS

BACKGROUND OF THE INVENTION

This application is a continuation in part of Ser. No. 08/689,013 filed on Jul. 30, 1996, now abandoned.

FIELD OF THE INVENTION

The present invention relates generally to coverings for boots, and more particularly, to a ski boot cover which is impervious to snow, moisture and wind and provides thermal insulation from the cold. Further, the ski boot cover permits the ski boot to be placed into the front ski bindings and the rear ski bindings as well as permitting the wearer to utilize adjustment devices located on the external surface of the shaft of the ski boot.

DESCRIPTION OF THE PRIOR ART

The cooling of the extremities and in particular the feet has long been recognized as a problem in outdoor activities, especially in the winter months. Ski resorts often experience particularly extreme conditions, and skiers often remain on the slopes for long periods of time. While skiing, the booted foot is exposed to snow, ice, slush, moisture and other cooling actions such as wind chill. Periods of inactivity also lend to the feeling of cold. The hard outer shell of the ski boot is susceptible to cold and frost which then conducts heat from the inner lining out through the outer shell. Although ski boots do have insulation, cold toes and feet are a commonplace problem and freezing often results. Many skiers suffer from frostbite every season. Having cold toes detracts from the enjoyment and duration of the skiing experience. Various methods have been employed to increase the thermal insulation on the boots by adding attachable covers such as wraparound devices. These devices envelope the entire boot and are generally secured by rear or side mounted zippers which connect the covering about the calf of the leg. While these methods may be somewhat effective, they do not permit the wearer to manipulate devices which are common in modern ski boot design.

Current ski boot designs include a variety of adjustment devices located on the outside of the shaft of the ski boot. These include canting adjusters, which permit a lateral adjustment of the ski boot for those skiers who supinate or pronate during skiing, a power lock, which locks the ski boot in a forward leaning position, a walk-ski setting, which permits the boot to flex while walking sans skis, as well as a variety of other devices. It is to be understood that a variety of other ski boot adjustment devices exist, and this discussion applies to those devices as well. These adjustment elements are located on the outside of the shaft of the ski boot, generally on the right side on the right ski boot, the left side on the left ski boot or on the rear of the ski boot. These adjustment elements includes switches, with an on and off position, key operated devices, and dials. As ski boot adjustment technology continues to mature, other such heretofore unknown hand manipulable external adjustment elements will become commonplace.

As such, the currently utilized covers for ski boots prevents the wearer from being able to manipulate the various devices located on the external surface of the ski boot without first removing the cover or gaiter. It is also impossible for the wearer to unlatch the top ski boot attachment latches (there are generally three) for comfort while resting without first going through the trouble of removing the cover.

Thus, while the foregoing body of prior art indicates it to be known to use a form of ski boot coverings in cold conditions, a ski boot covering with provision to permit the manipulation of external ski boot adjustment devices has not been contemplated. Nor does the prior art teach a device which may be utilized on a modern ski boot without interfering with the ski bindings. The prior art devices are cumbersome with respect to cant (both rear and side) adjustment, ski-walk adjustment and other external adjustment features. The foregoing disadvantages are overcome by the unique structure of the present ski boot cover which adds a thermal insulative layer over the toes, instep and lower sides of the ski boot, while leaving the external adjustment devices uncovered. This permits their use without removal of the present ski boot cover as will be made apparent from the following description thereof. Other advantages of the present invention over the prior art also will be rendered evident.

SUMMARY OF THE INVENTION

To achieve the foregoing and other advantages, the present invention, briefly described, provides a ski boot cover including a body which includes a generally triangular body portion permanently connected about the front and including releasable connection means about the rear. Although the ski boot cover for the right ski boot is essentially the same as the ski boot cover for the left ski boot there are some minor differences which will be specifically pointed out in the below discussion and will be clearly differentiated in the drawing figures.

The generally triangular body of the ski boot cover has a perimeter which includes a first side, a second side and a third side. A first strip element connects the first side of the body to the second side of the body. The first strip has two sides, the first side of the strip is connected to the first side of the triangular body generally about the midpoint of the first side of the triangular body. The connection may be made by stitching, thermal bonding, adhesive, or a combination thereof. The second side of the strip is connected to the second side of the triangular body generally about the midpoint of the second side of the triangular body. The connection may also be made by stitching, thermal bonding, adhesive, or a combination thereof. An aperture designed to receive the front portion of the ski boot is formed between the first strip, first side and second side. The point of connection of the first and second sides of the first strip to the first and second side of the triangular body may be adapted to fit different sized ski boots. The point of connection may be anywhere intermediate the general area of ¼ of the length of the first and second sides and ¾ of the length of the first and second sides. The preferred point of connection is closer to ¼ of the length of the first and second sides.

Means to attach the first side to the second side about the back of the ski boot is provided in the form of a second strip. On the left ski boot cover the second strip is preferably attached to, and depends from, a region about the apex (intersection) of the first side and the third side. The second strip further includes a distal end. An attachment element is provided permitting the attachment of the distal end to the apex of the second side and the third side on the left ski boot cover.

On the right ski boot cover the second strip is preferably attached to, and depends from, a region about the apex (intersection) of the second side and the third side. The second strip includes a distal end. An attachment element is provided permitting the attachment of the distal end to the apex of the first side and the third side on the right ski boot cover.

The attachment element will be permanently secured to the appropriate side depending on whether it is the right or left ski boot cover being manufactured. In the preferred embodiment, hook and loop fasteners (Velcro—TM), are located on the distal end and the attachment element. Other fastening means, including snaps, zippers, and buttons may also be employed.

The aperture formed by the first side, the second side and the first strip provides an opening for receiving the front portion of the ski boot. This permits the body to surround and cover the upper portion of the ski boot from the toe to the instep, as well as about the generally lower portion of the right and left sides. The body is further releasably affixed about the rear of the ski boot by the mating of the hook and loop fasteners between the second strip and the attachment element. The first and second sides are cut to such a configuration so that the body of the cover, when secured to the ski boot, permits the wearer to manipulate externally located adjustment devices.

In the preferred embodiment, the body of the ski boot cover will be made from closed cell neoprene. The neoprene may be covered on one or both sides by nylon. Neoprene enjoys excellent insulative and waterproof properties over a wide range of temperatures. The neoprene is somewhat elastomeric and forms a snow, wind and moisture impervious barrier. It fits closely and snugly about the ski boot and will not easily detach. The nylon covered neoprene may come in a variety of colors, and may include bright "day-glow" or fluorescent colors for better visibility. Other colors, such as black, red, green or blue may be preferred. White offers excellent camoflauge and may have military or espionage applications. Other fabrics and materials may be employed in the construction of the ski boot cover body. The first strip and the second strip may be constructed of reinforced nylon webbing which has good material properties with respect to strength and temperature. Other materials may be employed for the first and second strip, including rubber and rubberized fabrics.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new ski boot cover which permits the wearer to manipulate externally mounted adjustment devices, including, but not limited to, rear and side cants, walk or ski mode devices, and forward lean power locks.

It is another object of the present invention to provide a new ski boot cover which may be easily and efficiently manufactured and marketed.

It is a further objective of the present invention to provide a ski boot cover which is of durable and reliable construction.

An even further object of the present invention is to provide a new ski boot cover which is susceptible of a low cost of manufacture with regard to both materials and labor, and which accordingly is then susceptible of low prices of sale to the consuming public, thereby making such a ski boot cover available to the buying public.

Still yet a further object of the present invention is to provide a new ski boot cover which may be manufactured in a plurality of colors, including day-glow or fluorescent colors.

It is still a further object of the present invention is to provide a new ski boot cover which may be constructed of a thermally insulative material such as a neoprene composition.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new ski boot cover embodying the principles and concepts of the present invention will be described.

FIGS. 1–5 show the right ski boot cover 10 to be deployed on the right ski boot 12. The left boot cover 50 is described in FIG. 6.

Figure 1:
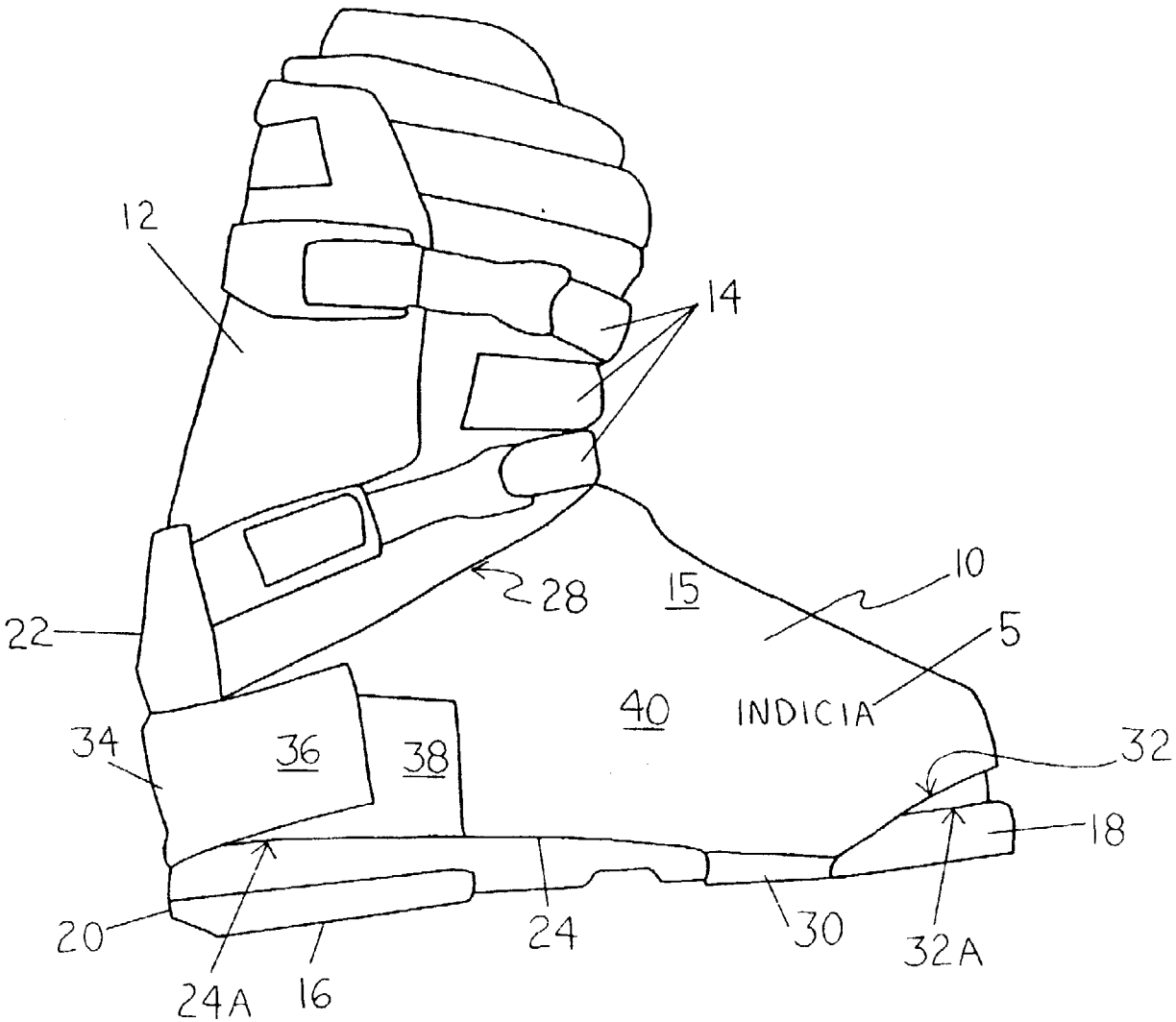
FIG. 1 is a view showing the ski boot cover attached about the right ski boot as seen on a first side.
Figure 2:
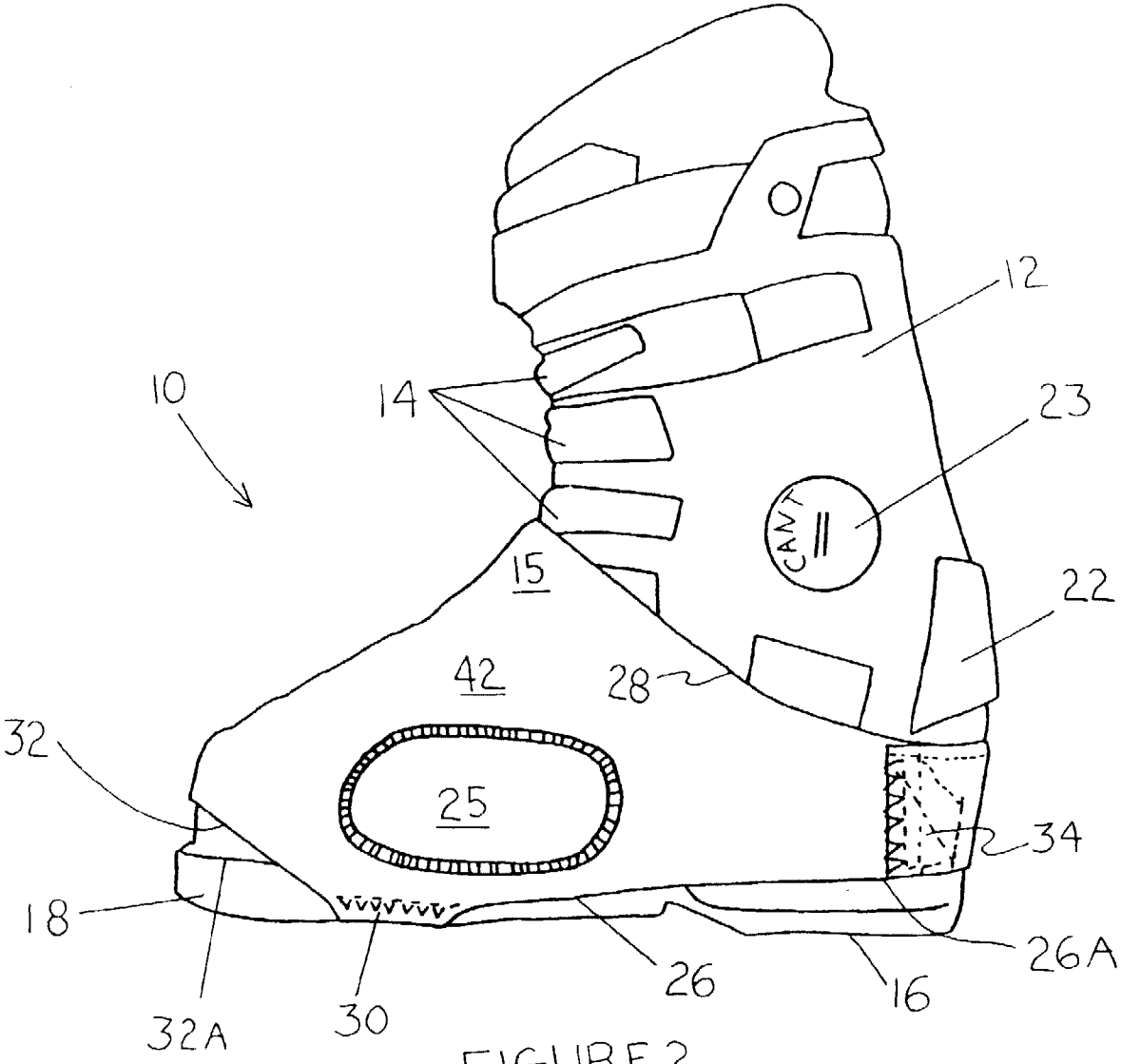
FIG. 2 is a view of the ski boot cover attached about the right ski boot as seen on a second side.

Referring now to FIGS. 1 and 2, the ski boot cover 10 is shown deployed on the right ski boot 12. The boot 12 includes latches 14, bottom 16, front 18 and back 20. Element 22 may be considered to be a rear cant adjustment, a rear release system, a ski-walk mechanism, a power lock or another hand manipulable adjustment device. In this view, the ski boot cover 10 has a first side 24 and a third side 28. A first strip 30 connects the first side 24 to a second side 26 (see FIG. 2). A patch 25 is located on the inner side of the ski boot cover 10. The patch 25 may be constructed of any appropriate material, preferably leather. The patch 25 will keep the opposing boot and ski from damaging the ski boot cover 10 during skiing, walking, or being carried by the lift. Without such an additional protective layer, the ski boot cover may disintegrate under the impact of the opposing ski and boot. The patch 25 is preferably located about the ball of the foot, as it had been shown that this area suffers the most impacts.

An opening 32 is formed in the ski boot cover 10 by the connecting of the first side 24 to the second side 26 by the first strip 30. The opening 32 is formed forward of the first strip 30. The first strip 30 is connected in a permanent fashion to both the first side 24 and the second side 26. The first strip 30 is generally rectangular with the portion which attaches to the first side 24 and the second side 26 being the minor sides of the rectangle, and the major sides of the rectangle being generally greater than 3 times the minor sides of the rectangle. This rectangular first strip 30 is secured by stitching or other permanent means, including heat welding or adhesive. The opening 32 is designed to receive the front 18 of the boot 12. A portion of the toe of the boot will be received within the opening 32 and will be exposed, ie: non covered. Specifically, at least the feather edge 32A of the boot will be exposed permitting the ski boot to mate with the front ski binding without interference from the ski boot cover 10. As seen in FIGS. 1 & 2, the ski boot cover significantly covers the front portion and lower side portion of the ski boot 12, yet would not interfere with the mating engagement of the front portion 18 of the boot 12 or the rear portion of the boot 20 with the ski bindings and the friction plate (not shown). Also, it is shown that the ski boot cover 10 would permit the wearer to access rear mounted hand manipulatable element 22. It is clear that the upper latches 14 also remain free and are able to be released without removing the ski boot cover 10. The third side 28 resides just below the latches 14. In FIG. 2, a side cant 23 is shown. A side cant 23 is generally adjusted be an elongated key, a dial or a knob. The ski boot cover 10 would not interfere in anyway from a user making any such adjustments to the side cant 23. Referring to the third side 28, one may note the negative slope of the portion beginning at the upper area of the instep and going in a downward fashion to the second strip 34. This downward slope is critical as it leaves the entire boot shaft exposed, which permits one to access boot adjustment mechanisms (previously discussed) as well as actuate the latches of the boot. Elements 24A and 26A are cut away portions of the first side 24 and the second side 26. Elements 24A and 26A taper in an upward fashion to the strip 30. This, along with the placement of the second strip 34, permits a portion about the rear of the boot to remain exposed, permitting the boot to be easily placed within the rear ski binding.

The first side 24 and the second side 26 are also connected generally about the rear 20 of the ski boot 12. A second strip 34 wraps about the rear 20 of the ski boot where it mates with the other side. In the embodiment shown in the figures, second strip 34 is permanently attached generally about the apex or intersection of the second side 26 and the third side 28. The second strip 34 includes a distal end 36. The distal end 36 is removably attachable about the apex or intersection of the first side 24 and the third side 28. An attachment element 38 is located at the intersection of the first side 24 and the third side 28. The attachment element 38 is permanently affixed. The distal end 36 and the attachment element 38 include a plurality of hook and loop fasteners which cooperatively and matingly interlock in an easily releasable and adjustable manner. Other non-permanent fastening arrangements may be utilized to affix the distal end 36 to the attachment element 38.

Second strip 34 may be tensioned tightly about the boot rear 20. The second strip 34 may be comprised of a reinforced nylon, or some other material. An elastic material may be employed as the second strip 34. This second strip 34 will further include hook and loop fasteners. Second strip 34 is designed to be an elongated rectangular strip. In the preferred embodiment the major sides of the second strip will be greater than generally 5 times the minor sides of the second strip. The second strip 34 will be long as it may fit about any sized ski boot. The body 15 of the ski boot cover 10 may be manufactured from a somewhat elastic material permitting the body 15 to stretch about the surface of the ski boot 12. The body 15 may be preferably comprised of closed cell neoprene, or any other material with the desired material properties. This material has some elasticity and will permit a generic sized ski boot cover to manufactured. The boot cover 10 may include generic sizes such as a small, medium and large. These sizes, due to the elasticity of neoprene, will fit all ski boots. The ski boot cover includes an inside, which would reside specifically against the outer surface of the boot, and an outside, that would be exposed to the environment. The outside surface may include indicia 5, that may identify the owner of the boot cover, whether it is the right or left boot cover, and/or the manufacturer of the boot cover. Other indicia may be present as well, including ornamental designs.

Figure 3:
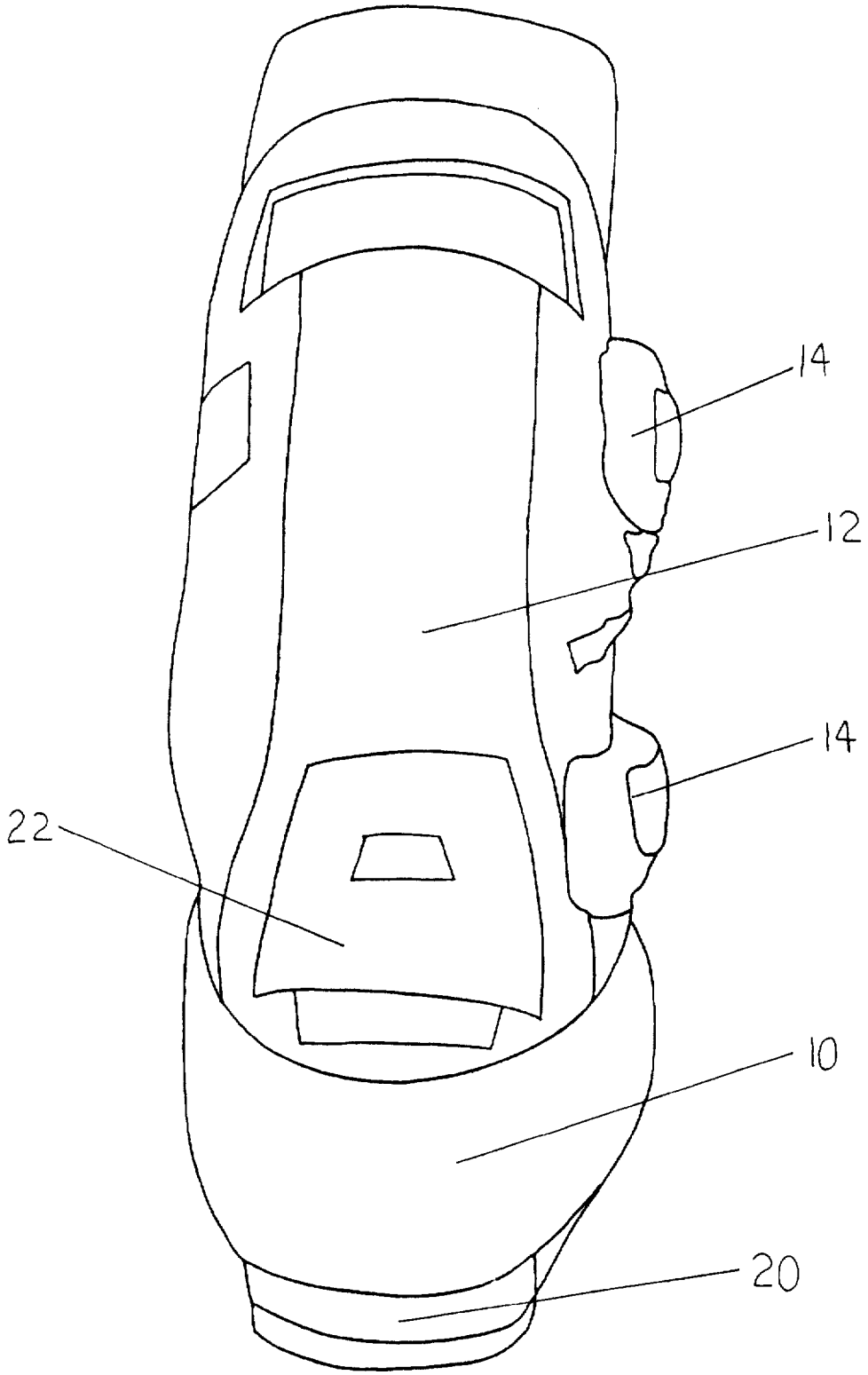
FIG. 3 is a view of the ski boot cover attached about the right ski boot as seen from the rear.

Referring now specifically to FIG. 3, a view of the ski boot cover 10 as seen looking at the rear of the ski boot 12 is shown. The ski boot cover 10 is located intermediate the bottom rear 20 of the ski boot 12 and element 22. Element 22 may be considered to be a rear cant, a rear release system, a ski-walk mechanism, a power lock or another hand manipulable adjustment device. It is easily seen that the ski boot cover 10 will not interfere with the use of element 22, or foul the bottom rear 20-ski binding interface.

Figure 4:
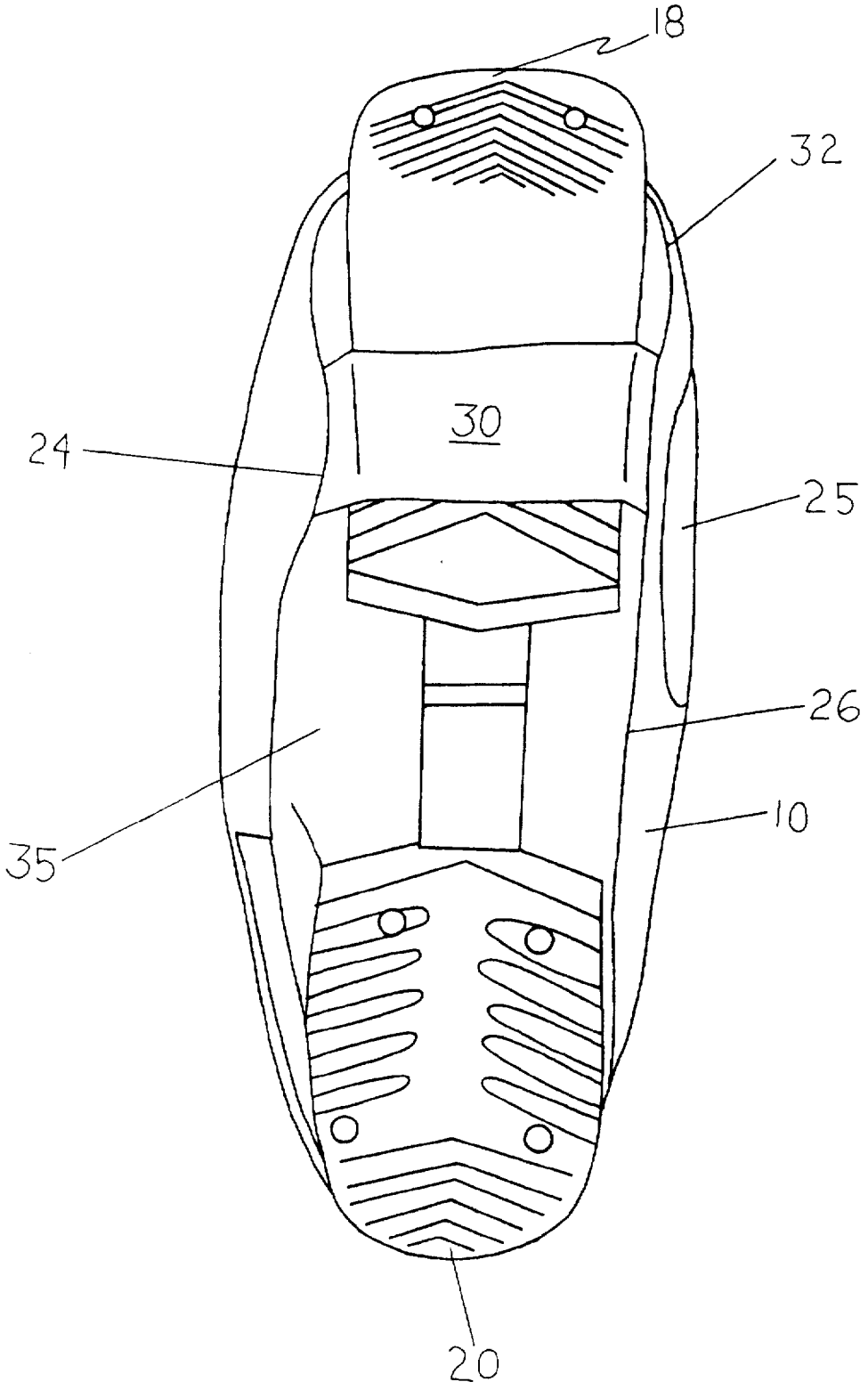
FIG. 4 is a view of the ski boot cover attached to the right ski boot as seen from the bottom.

Referring now to FIG. 4, a view of the ski boot cover 10 as seen looking at the bottom of the ski boot 12 as shown. First strip 30 is shown intermediate the first side 24 and the second side 26. The first strip 30 may be comprised of reinforced nylon or some other material including materials with elastomeric properties. The first strip 30 connects the first side 24 to the second side 26. The front 18 of the ski boot is shown mated with the aperture 32 formed forward of first strip 30 and the first side 24 and the second side 26. As can be seen, the first strip 30 only covers a small portion of the whole bottom 35 of the ski boot 12. This is important as a tight fit between the boot and the ski binding is critical. This permits one having as much of the boot on the ski as possible. The ski boot cover 10 does not interfere with the toe or heel piece mating to the ski binding or friction plate. The position of the first strip 30 is located forward of the halfway portion of the boot, but may vary with design.

Figure 5:
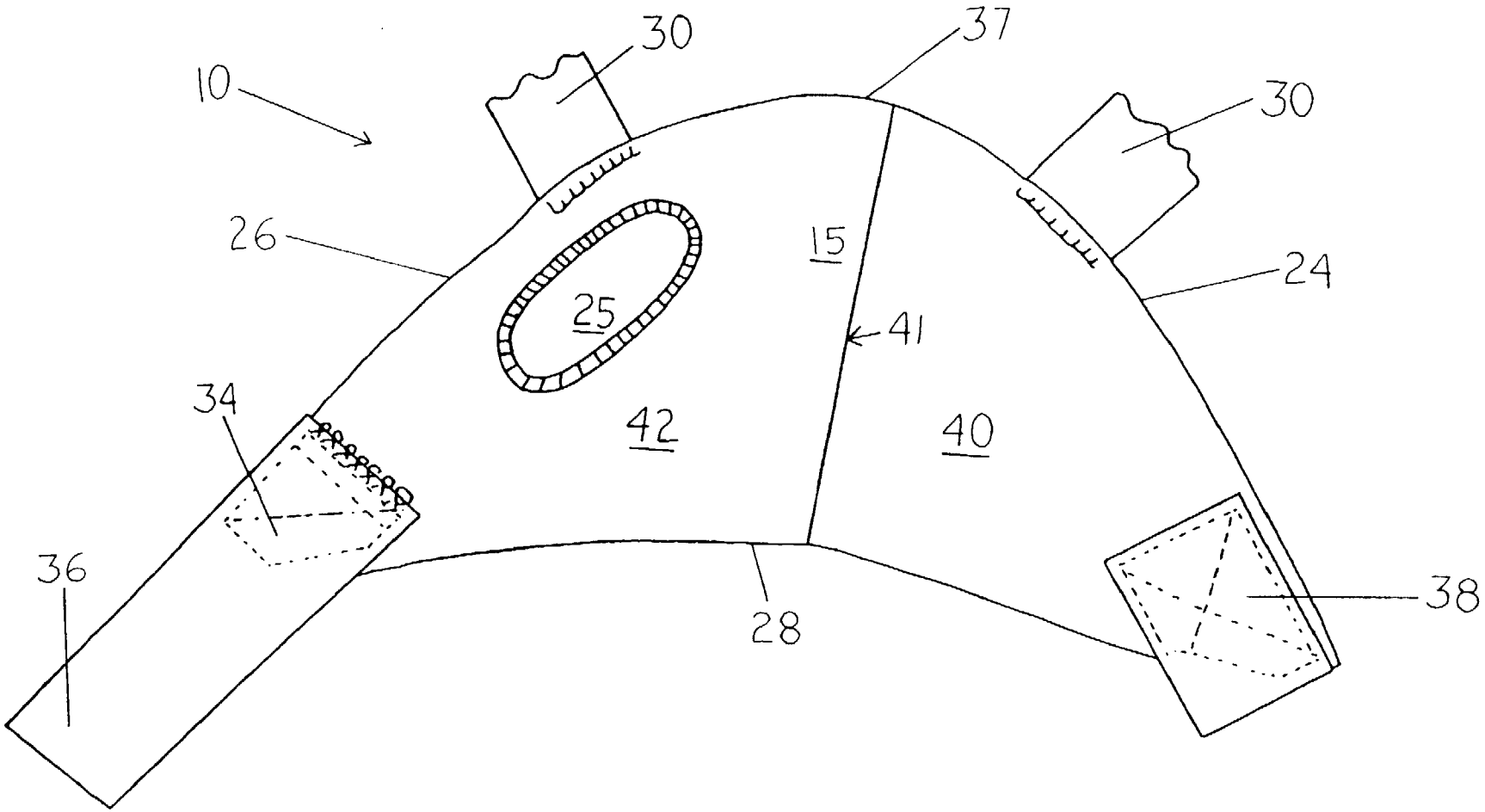
FIG. 5 is an outside view of the right ski boot cover laid open.

FIG. 5 shows the right ski boot cover 10 generally laid open and being viewed from the outside. The generally triangular appearance of the body 15 may be seen by the connection of the first side 24, second side 26 and third side 28. Note that at the general area of intersection of the first side 24 and the second side 26 is a curved portion 37. The body 15 includes a right portion 40 and a left portion 42. In some embodiments the right portion 40 may be connected to the left portion 42 by stitching or welding about line 41. In another embodiment, the right portion 40 and the left portion 42 will be of a unitary construction. First strip 30 is broken in this figure in order to lay open the ski boot cover 10. It may seen that the first strip 30 is connected to the first side 24 and the second side 26. The patch 25 is located generally proximal the second strip 34 on the left portion 42. The second strip 34 is connected about the apex or intersection of the second side 26 and the third side 28. The attachment element 38 is connected about the apex or intersection of the first side 24 and the third side 28. On the distal end 36 and on the attachment element 38 reside a plurality of hook and loop fasteners. Distal end 36 fastens second strip 34 to the attachment element 38.

Figure 6:
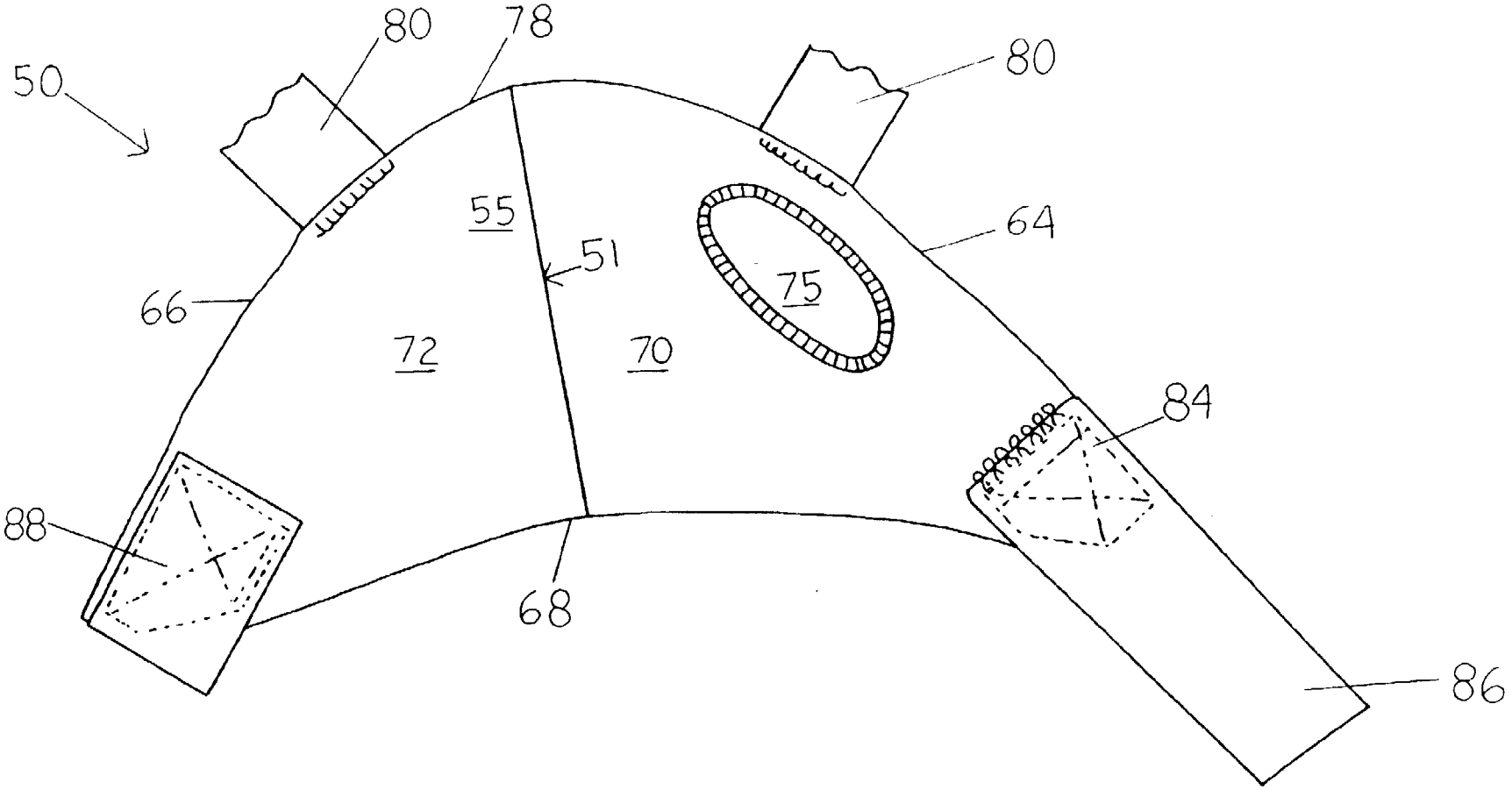
FIG. 6 is an outside view of the left ski boot cover laid open.

FIG. 6 shows the left ski boot cover 50 generally laid open and being viewed from the outside. The generally triangular appearance of the body 55 may be seen by the connection of the first side 64, second side 66 and third side 68. Note that at the general area of intersection of the first side 64 and the second side 66 is a curved portion 78. The body 55 includes a right portion 70 and a left portion 72. In some embodiments the right portion 70 may be connected to the left portion 72 by stitching or welding about line 51. In another embodiment, the right portion 70 and the left portion 72 will be of a unitary construction. First strip 80 is broken in this figure in order to lay open the ski boot cover 50. It may seen that the first strip 80 is connected to the first side 64 and the second side 66. The patch 75 is located generally proximal the second strip 84 on the right portion 70. The second strip 84 is connected about the apex or intersection of the first side 64 and the third side 68. The attachment element 88 is connected about the apex or intersection of the second side 66 and the third side 68. On the distal end 86 and on the attachment element 88 reside a plurality of hook and loop fasteners. Distal end 86 securely fastens second strip 84 to the attachment element 88.

It is apparent from the above that the present invention accomplishes all of the objectives set forth by providing a new ski boot cover which permits the wearer to manipulate any externally mounted adjustment devices, including, but not limited to, rear and side cants, walk or ski mode devices, and forward lean power locks.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A ski boot cover for a ski boot, the ski boot having a toe portion, a sole, an upper, a heel, and a shaft, said cover comprising:

a body including a right portion and a left portion, said right portion and said left portion being connected by a bottom strip, said right portion, said left portion and said bottom strip forming an opening, said opening for receiving the toe portion of the ski boot therethrough, leaving the toe portion of the ski boot exposed, an elongated rear strip having a first side and a second side, said first side of said rear strip connected to said left portion, said second side of said rear strip including releasable attaching means for attaching said second side to said right portion, leaving the portion of the ski boot to the rear of the instep proximal the heel exposed, whereby when the toe portion of the ski boot is received through said opening, and said rear strip is secured about the rear of the ski boot, the instep and sides of the ski boot are covered by said body, leaving the shaft of the boot exposed.

2. A ski boot cover as claimed in claim 1 wherein said body is comprised of a material containing neoprene.

3. A ski boot cover as claimed in claim 1 wherein said releasable attaching means comprises hook and loop fasteners.

4. A ski boot cover as claimed in claim 1 wherein said right portion and said left portion are permanently connected to said bottom strip.

5. A ski boot cover as claimed in claim 4 wherein said bottom strip is generally rectangular.

6. A ski boot cover as claimed in claim 1 wherein the perimeter of the cover from generally about the upper portion of the instep to said rear strip slopes downwardly.

7. A ski boot cover as claimed in claim 1 including a patch, said patch located on said left portion, generally above said bottom strip.

8. A ski boot cover as claimed in claim 1 wherein said toe portion includes the feather edge of the boot.

9. A ski boot cover as claimed in claim 1 wherein said cover has an interior portion which rests against the boot, and an exterior portion which is exposed to the environment, said exterior portion including indicia.

10. A ski boot cover for covering the portion of the ski boot located generally below the upper region of the instep, said ski boot cover permitting access to ski boot latches and ski boot adjustment devices located above the upper region of the instep on the boot shaft, said ski boot further having a toe portion and a rear portion, the toe portion and the rear portion to be matingly engaged to the front and rear ski binding located on the ski, said ski boot cover comprising:

a body including a right portion, and a left portion, said right portion and said left portion being connected by a bottom strip, said right portion, said left portion and said bottom strip forming a front opening, said front opening designed to receive the toe of the ski boot therethrough, with the bottom strip resting on the bottom of the boot, leaving the toe of the ski boot exposed, an elongated rear strip having a first side and a second side, said first side of said rear strip connected to said left portion, said second side of said rear strip being releasably attached to securing means located on said right portion, leaving the portion proximal the heel of the ski boot exposed, whereby when said boot covering is placed atop the ski boot, the ski boot located below the upper portion and to the rear of the instep is thermally insulated by said body, and the toe portion of the ski boot may matingly engage the binding, and the rear portion of the ski boot may matingly engage the binding, and the wearer may access both the ski boot adjustment devices as well as have access to the latches.

11. A ski boot cover as claimed in claim 10 wherein when the toe portion of the ski boot is received through said front opening, and said rear strip is secured about the rear of the ski boot, the instep and sides of the ski boot are covered by said covering, leaving the shaft of the boot exposed.

12. A ski boot cover as claimed in claim 10 wherein said body is comprised of a material containing neoprene, and also wherein said releasable attaching means comprises hook and loop fasteners.

13. A ski boot cover for a ski boot, the ski boot including a toe portion, a heel, an instep, a boot shaft, said boot further including external boot adjustment devices located on the boot shaft, said cover being placed atop the boot on the right foot comprising:

a body including a right portion, and a left portion, said right portion and said left portion being connected by a bottom strip, said right portion, said left portion and said bottom strip forming an opening, said opening receiving the toe portion of the ski boot therethrough, leaving the toe portion of the ski boot exposed, an elongated rear strip having a first side and a second side, said first side of said rear strip connected to said left portion, said second side of said rear strip including releasable attaching means for attaching said second side to said right portion, leaving the portion of the ski boot proximal the heel exposed, whereby when the toe of the ski boot is received through said opening, and the rear strip is secured about the rear of the ski boot, the instep and sides of the ski boot to the rear of the instep are covered by said body, leaving the latches and boot adjustment devices exposed located on the boot shaft exposed.

14. A ski boot cover as claimed in claim 13 wherein said body is comprised of a material containing neoprene, and said releasable attaching means comprises hook and loop fasteners.

15. A ski boot cover as claimed in claim 13 wherein said right portion and said left portion are permanently connected to said bottom strip.

16. A ski boot cover as claimed in claim 13 wherein said bottom strip is generally rectangular.

17. A ski boot cover as claimed in claim 13 wherein the perimeter of the cover from generally about the upper portion of the instep to said rear strip slopes downwardly.

18. A ski boot cover as claimed in claim 13 including a patch, said patch located on said left portion, generally above said bottom strip.

19. A ski boot cover as claimed in claim 13 wherein said toe portion includes the feather edge of the boot.

20. A ski boot cover as claimed in claim 13 wherein said cover has an interior portion which rests against the boot, and an exterior portion which is exposed to the environment, said exterior portion including indicia.

* * * * *